US005290017A

United States Patent [19]

Hemsath et al.

[11] Patent Number: 5,290,017

[45] Date of Patent: Mar. 1, 1994

[54] COOLING COVER FOR BATCH COIL ANNEALING FURNACE

[75] Inventors: Klaus H. Hemsath, Toledo; James E. Lyon, Perrysburg, both of Ohio

[73] Assignee: Indugas, Inc., Toledo, Ohio

[21] Appl. No.: 24,447

[22] Filed: Mar. 1, 1993

[51] Int. Cl.[5] ..... C21D 1/00

[52] U.S. Cl. ..... 266/263; 266/256

[58] Field of Search ..... 266/256, 263, 264, 259, 266/249; 432/148

[56] References Cited

U.S. PATENT DOCUMENTS

| | | | |
|---|---|---|---|
| 3,832,129 | 8/1974 | Derbyshire et al. | 266/256 |
| 4,278,242 | 7/1981 | Freund et al. | 266/263 |
| 4,310,302 | 1/1982 | Thekdi et al. | 266/263 |
| 4,596,526 | 6/1986 | Soliman | 266/256 |
| 4,846,675 | 7/1989 | Soliman | 266/256 |
| 4,891,008 | 1/1990 | Hemsath | 432/148 |

*Primary Examiner*—Scott Kastler

*Attorney, Agent, or Firm*—Frank J. Nawalanic

[57] ABSTRACT

An improved cooling cover is disclosed for use in bell shaped annealing furnaces. The cooling cover includes a jet nozzle orifice arrangement which develops jet streams from a low pressurized supply of air at ambient temperature in the plenum chamber of the cooling cover. A multitude of free standing jet streams thus impinge the inner cover of the bell shaped annealing stand to produce improved cooling times. Importantly, the plenum chamber includes strategically placed axial jet pump outlets which are effective to draw the jet streams from the cooling cover after they have been in heat transfer contact with the inner cover in a distribution pattern which is not altered so that the work or coils within the inner cover can be more uniformly cooled than heretofore possible. The spent jet streams are withdrawn from the cooling cover in a manner which does not affect the initial impact of the jets with the inner cover while establishing a neutral to slight under pressure at the base of the cooling cover to prevent sand seal upset and hot gas backwash.

24 Claims, 7 Drawing Sheets

COOLING COVER FOR BATCH COIL ANNEALING FURNACE

This invention relates generally to heat treat processes and more particularly to method and apparatus for performing heat treat processes in bell shaped furnaces typically used for batch coil annealing steel strip.

The invention is particularly applicable to accelerated cooling of vessels and will be described with specific reference to a cooling cover for use in a batch coil annealing furnace. However, the invention has broader application and is not necessarily limited to cooling but can, conceptually, also be used to heat the work.

INCORPORATION BY REFERENCE

The following patents are incorporated herein by reference so that fundamental concepts, designs and processes need not be discussed nor disclosed in detail herein:

| Inventor | U.S. Pat. No. |
|---|---|
| Hemsath | 4,891,008 |
| Soliman | 4,846,675 |
| Thekdi | 4,310,302 |

BACKGROUND

Bell shaped annealing furnaces are typically used for batch coil annealing of metal strip wound into coils. A plurality of coils are vertically stacked one on top of the other (separated by diffuser plates) onto a fixed annealing stand or base. The coils are covered with an inner cover which is sealed (removably) to the annealing stand. An outer cover, typically sealed also to the annealing stand, surrounds the inner cover. The outer cover typically carries burners or a source of heat which heats the outside surface of the inner cover which in turn radiates the heat to the coils therein. The coils are heated until they reach their transformation temperature and they are held at this transformation temperature until temperature uniformity has been achieved throughout the coil. At that time the coils are then cooled to achieve the desired annealing. As noted, the inner cover is sealed to the base and a protective atmosphere is usually maintained within the inner cover while heating to a transformation temperature. This inner atmosphere is typically a HNX (hydrogen-nitrogen) composition. The invention can also be used with pure hydrogen.

Cooling of the coils after heating is the longest stage of the annealing cycle. Typically, it takes twice the time to cool the work when compared to the time it takes to heat the work. The availability of annealing stands or furnace bases is often limited in the mill and plant capacity is thus set by the cycle times and available number of bases. Cooling time reduction is thus the easiest way to increase base throughput and thus plant capacity.

In the batch coil annealing process as initially practiced, after the work was heated, the outer cover was simply removed and heat was exchanged between ambient air and the inner cover to accomplish cooling. Today cooling is performed usually with a cooling cover. Most cooling covers are updraft type covers. These covers pull air over the face of the hot inner cover and exhaust the heated air at the top. Methods have been tried to improve air flow turbulence thus increasing cooling of the inner cover but often, especially with sand seals, problems are encountered.

Other cooling methods use water. Water is either directly sprayed on the cover at the top so it flows down the inner cover. Alternately, water can be sent through heat exchange coils in the base where it cools the protective atmosphere. One type of a heat exchange coil used for cooling mounted in the base is marketed under the brand name "INTRAKOOL". Use of water requires extra measures and additional operating equipment and further adds to maintenance needs. The problems typically encountered with internal exchangers is simply failure of the heat exchanger resulting from thermal shock which occurs when water is pumped into a coiled hot tube. Cooling the inner cover by pouring water over the inner cover also presents operational and maintenance problems. Thus the trend is to use air cooling covers in which air is directed against the inner cover and high heat transfer rates are achieved.

One type of such cover was developed by the assignee of the present invention and this invention is viewed as an improvement over the assignee's earlier design. In that design, a structure and concepts similar to that disclosed in Hemsath U.S. Pat. No. 4,891,008 was employed. More specifically, a plenum chamber was formed in the top end of the outer cover and extending from the top end of the outer cover was a plurality of circumferentially spaced, longitudinally extending distribution tubes. Each tube, was in fluid communication with the plenum chamber at one axial end and each tube had a plurality of orifices drilled at longitudinally spaced increments along its length. When ambient air was pulled by a fan into the plenum chamber and pumped into the distribution tubes, the orifices metered the ambient air out of the distribution tubes as free standing jet streams of high velocity which impinged the cooling covers to further enhance or speed up the cooling of the inner cover. The jet pumps developed from the distribution tubes were effective to significantly decrease the cooling time. However, some initial operational problems were encountered which led to the development of the invention set forth herein. Of some concern was the cooling pattern developed on the inner cover by the variation of jet velocity resulting, to some extent, from the fundamental orifice-longitudinal tube arrangement. Even so, the cooling rates achieved by the jet streams in the early design was far superior to that achieved by other cooling covers in use. However, another problem, which has also plagued other cover installations, resulted from the fact that the large flow of cooling air impinging the inner cover exerts a positive pressure at the base of the cooling cover. Should the base of the cover be an elastomer seal positively clamped by a mechanical hydraulic device compressing the seal, the positive pressure exerted at the base of cooling cover does not present any significant concern. However, if the seal for the cover is the traditional sand seal, then the positive pressure within the cover will disturb the sand and break the sand seal. This presents a major dust problem which the present invention overcomes.

SUMMARY OF THE INVENTION

It is thus a principal object of the present invention to provide an improved cooling cover which develops an improved cooling pattern imprinted or effected on the inner cover of a bell shaped annealing furnace while simultaneously maintaining a neutral or slight under pressure at the base of the cooling cover to avoid seal upset.

This object along with other features of the invention is achieved by means of an outer cover which is used as a staple component or element of a bell shaped furnace in which the outer cover surrounds an inner cover within which work to be heat treated is to placed. In accordance with a broad aspect of the invention a plurality of nozzle tubes within the outer cover are spaced adjacent to the inner cover with each tube having an orifice outlet, a plenum chamber pressurizes a gaseous medium within the tubes and generates free standing jet streams of a gaseous medium which moves into heat transfer impingement contact with the inner cover. A jet pump mechanism, formed in the outer cover, is effective to draw the jet nozzle streams, after impingement with the inner cover, out of the outer cover and inner cover in a manner in which the pressure between the outer cover at a position adjacent the base of the outer cover is neutral to slightly negative for ease in maintaining the seal of the outer cover while also permitting the jet impingement pattern to develop on the inner cover in an effective cooling manner.

In accordance with a more specific aspect of the invention the outer cover includes an outer cylindrical casing having a longitudinally extending body section, a closed top end and an open flanged bottom end. The cover also includes an inner cylindrical casing having a longitudinally extending distributor section, a closed top end and a bottom end with a plurality of jet nozzle means associated with the distributor section for directing jets of gaseous medium into heat transfer impingement contact with the inner cover. The inner casing is disposed within the outer casing to define a longitudinally extending heat transfer annulus between the inside of the outer casing's body section and the outside of the inner casing's distribution section, with the heat transfer annulus closed at its bottom axial end and open at its top axial end. The bottom end of the inner casing sits on an annular bottom support gusseted to the bottom of the outer casing to allow free thermal expansion to occur between the inner casing (which is adjacent the hot inner cover) and the outer casing (which is in contact with ambient air at ambient temperatures).

The top of the inner casing is also spaced a predetermined distance from the top end of the outer casing to define therebetween a plenum chamber with the top end of the heat transfer annulus in fluid communication with the plenum chamber. At least one draw opening is provided in a predetermined position within the top end of the inner and the outer casing. Associated with each opening is a jet pump mechanism for creating jet pump aspiration through the opening for positively drawing the gases within the outer cover out of the outer cover whereby the pressure within the outer cover adjacent the inner and outer casings bottom end is anywhere from slightly neutral (about one standard atmosphere) to slightly negative while the jet nozzle impingement pattern on the inner cover produces an enhanced heat transfer with the work within the inner cover.

In accordance with other features of the invention, a fan mechanism within the top end of the outer casing is provided for recirculating the gaseous medium at relatively low pressure within the plenum chamber. The fan mechanism includes a pair of diametrically opposed fan openings in the outer casing top end with a fan in each opening having an impeller for pulling ambient air into the plenum in opposite directions to one another whereby the ambient air is swirled about the plenum chamber thus insuring uniform distribution of wind mass into the heat transfer annulus and into the draw openings.

In accordance with another important aspect of the invention the jet nozzle mechanism includes a plurality of nozzle tubes extending radially inwardly from the distribution section of the inner casing to a position adjacent the inner cover with each tube having at its open end an orifice opening for developing a free standing circular jet of gaseous products which emanate therefrom whereby enhanced jet impingement with the inner cover occurs. A slat positioned or hinged to each nozzle just behind the orifice defines an "articulated" inner cylindrical wall spaced between the longitudinal section of the inner casing and the inner cover which cylindrical wall in combination with the longitudinal section of the inner casing defines an inner return annulus. The inner return annulus provides a path for the jet pump mechanism to pull the nozzle jets from the outer cover after they have impinged the inner cover. Importantly, the return path allows a preferred jet impingement pattern to be produced over the inner cover which in turn permits or helps in the uniform cooling of the coils within the inner cover.

In accordance with yet another aspect of the invention, the jet pump mechanism includes the draw opening in the inner casing top end having a cylindrical draw pipe of a first diameter extending therefrom and the draw opening in the outer casing having a cylindrical pipe of a second diameter mounted thereto. The second section pipe has a second diameter greater than the first diameter and longitudinally extends along the draw pipe for a predetermined distance whereby the suction pipe and the draw pipe define therebetween a jet pump annulus which causes the draw pipe to function as a pump for drawing, pulling or aspirating gases within the outer casing out of the outer cover whereby the pressure within the outer cover can be controlled.

In accordance with yet other specific aspects of the invention, a plurality of draw openings is provided with at least one draw opening overlying the inner return annulus to assure proper distribution of jet streams impinging the inner cover.

In accordance with another more specific aspect of the invention for single stand cooling covers, at least one draw opening is positioned radially inwardly from the draw opening overlying the inner return annulus.

In accordance with yet another specific aspect of the invention which relates to the geometry or relative positioning of the parts of the outer cover, the plenum chamber is divided into quadrants with the fans mounted in diametrically opposed quadrants and the draw openings overlying the heat transfer annulus positioned in quadrants adjacent those quadrants containing the fans whereby operation of the jet pump annulus of the draw pipe is assured.

In accordance with another aspect of the invention, the cooling cover invention is not limited to single stand annealing furnaces. Specifically application of the invention to multi-stand furnaces is contemplated. In such application, the multi-stand cooling cover is simplified over that required for a single stand. In particular, the invention contemplates an overall reduction in the number of jet pumps required for the installation in that the jet pumps need overlie only the inner return annulus and each fan is positioned for recirculating flow paths such that adjacent stand jet pumps are pressurized from only one fan. Importantly, the inner cylindrical wall is no longer articulated but is provided with a plurality of return annuluses which are geometrically positioned in the center of four nozzle tubes.

In accordance with yet another aspect of the invention a process for cooling work heat treated in a bell shaped furnace employing a bell shaped inner cover surrounding the work and a bell shaped outer cover surrounding the inner cover is disclosed. The process generally includes the steps of providing a plurality of nozzle tubes in the outer cover with each nozzle tube having an outlet orifice in close proximity to the inner cover. The steps of the process include developing a free standing circular jet of a gaseous cooling medium from each orifice of each tube and impinging the inner cover with the jets to effect heat transfer contact between the gaseous medium in the jets and the cover. The process also includes providing an exhaust or draw duct at a position remote from the nozzle jets and flowing a gaseous medium longitudinally within the duct about its walls to create a jet pump which jet pump is effective to draw or to help in drawing the gaseous atmosphere through the draw duct after the tube nozzle jets have impacted the inner cover and are spent.

It is thus another object of the invention to provide an outer cover which has improved heat transfer characteristics with an inner cover of a bell shaped furnace.

Yet another object of the invention is to provide an outer cover which permits easy, reliable sealing of the outer cover base with the furnace base in a manner in which the seal is not disturbed or pressurized when the outer cooling cover is cooling the work.

Yet another object of the invention is to provide an outer cover which will not only cool the work but also, with little modification, heat the work.

Still yet another object of the invention is to provide an improved process for cooling the inner cover of a bell shaped or batch coil annealing furnace.

It is still yet another object of the invention to provide a simple, cost efficient cover for use with bell shaped or batch coil annealing furnaces.

A still further object of the invention is to provide an improved method for achieving enhanced cooling of metal coils in a batch coil annealing heat transfer process.

It is another object of the invention to provide an improved cooling cover for both single and multi-stand batch coil annealing furnaces.

It is yet another object of the invention to provide improved convective cooling heat transfer co-efficients for a cooling cover than that which has heretofore been achieved.

It is still yet another object of the invention to provide a cooling cover which has improved heat transfer distribution patterns imposed on the inner cover to achieve more uniform cooling of the coiled work.

These and other objects of the present invention will become apparent to those skilled in the art upon reading and understanding the detailed description of the invention set forth below.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein:

FIG. 9 is a schematic illustration disclosing the nozzle jet impingement used in the present invention;

DETAILED DESCRIPTION OF THE INVENTION

Figure 1:
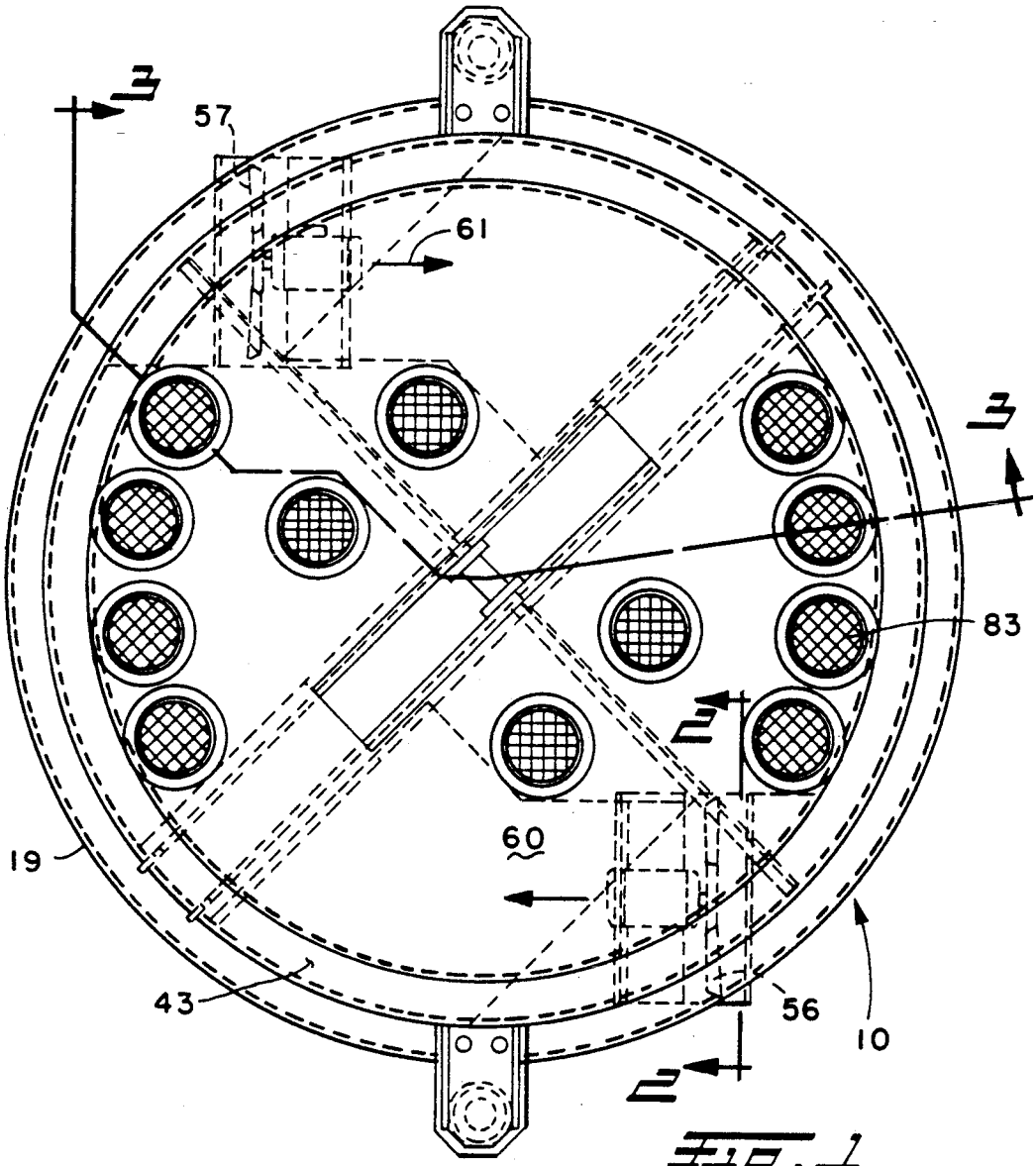
FIG. 1 is a top view of the cooling cover incorporating the invention.
Figure 3:
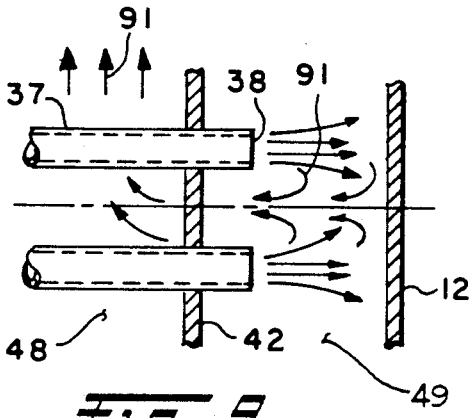
FIG. 3 is a longitudinally sectioned view of the cooling cover assembly shown in FIG. 1 taken along the lines 3—3 of FIG. 1.
Figure 3:
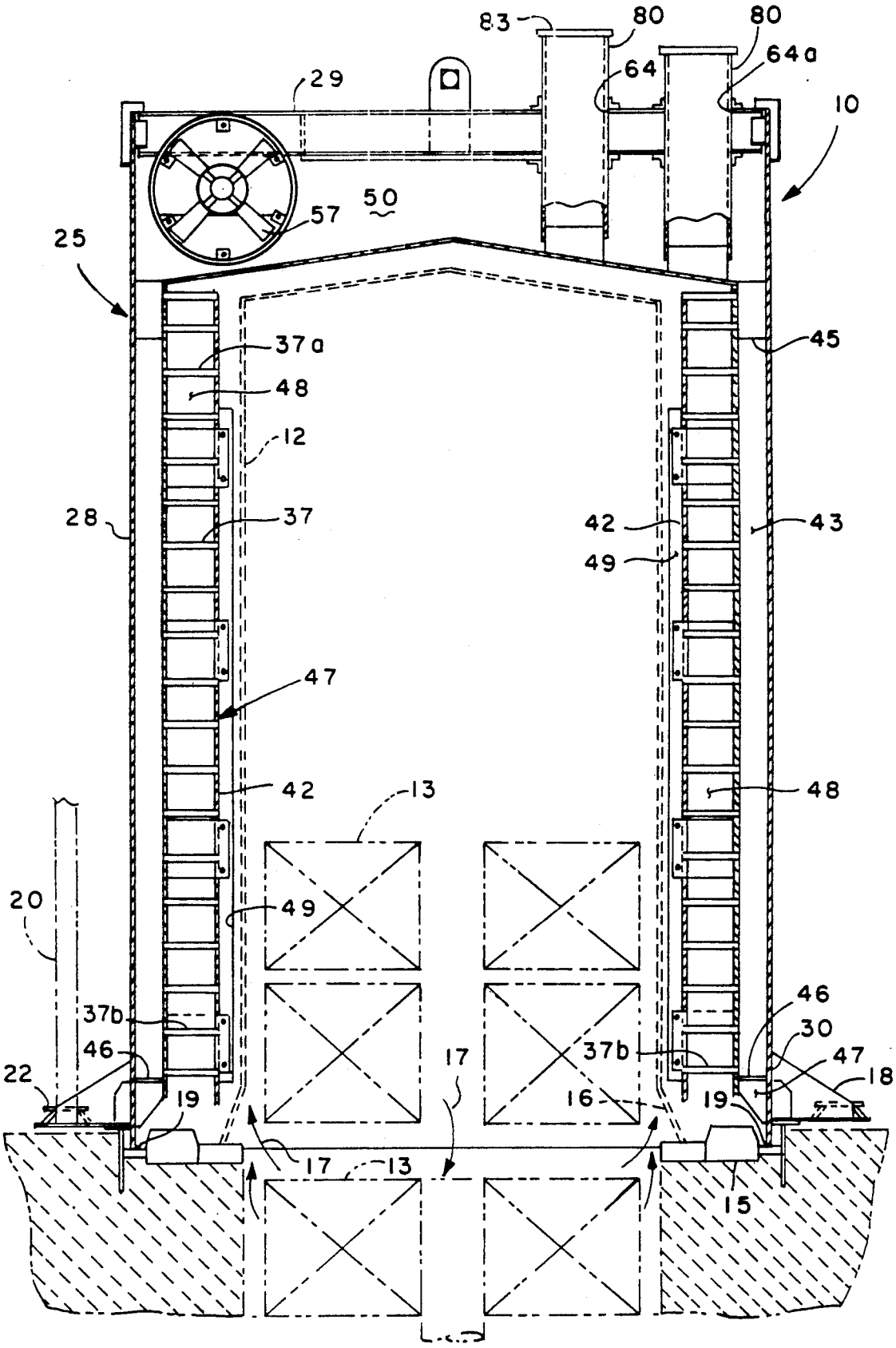

Referring now to the drawings wherein the showings are for the purpose of illustrating a preferred embodiment of the invention only and not for the purpose of limiting the same, there is shown in the drawings a cooling cover assembly 10 best shown in FIGS. 1 and 3. Referring to FIG. 3 this cooling cover 10 fits over an inner cover 12 which in turn sits over or surrounds or encloses work 13 which is diagrammatically shown as coils, typically steel coils which are annealed within the furnace. The work or coils 13 rest on an annealing stand or base diagrammatically shown by reference numeral 15. Within base 15 is a recirculating fan, shown by reference numeral 16, which circulates an annealing atmosphere (shown by reference numerals 17) within inner cover 12 for purposes of making the temperature of coils 13 more uniform. When inner cover 12 is heated (by a heating outer cover not shown herein) or cooled by cooling cover 10 fan 16 rotates to circulate atmosphere within inner cover 12 and thus effects convective heat transfer between work 13 and inner cover 12.

Inner cover 12 has a flange 16 sitting sealingly on base 15. Similarly, cooling cover 10 has a sealing flange 18 which is typically sealed in sand which is generally indicated by reference numeral 19. The sand seal is conventional. It can be fundamentally viewed as nothing more than an L-shaped lip which is enmeshed or covered within a ring of silicon sand. The sand surrounds the annular lip to form a seal therewith. A guide or positioning rod is shown by phantom lines 20, it being understood that the rod 20 fits within ears or eyelets 22 protruding from cooling cover 10 and perhaps best shown in FIG. 1. Everything thus far described is conventional. Specifically, the concept of a cooling cover 10 which is placed over inner cover 12 to cool inner cover 12 after coils 13 have been heated to a transformation temperature is old in the art. Similarly, using sand seals for sealing cooling cover 10 to an annealing stand or base 15 is conventional.

Figure 6:
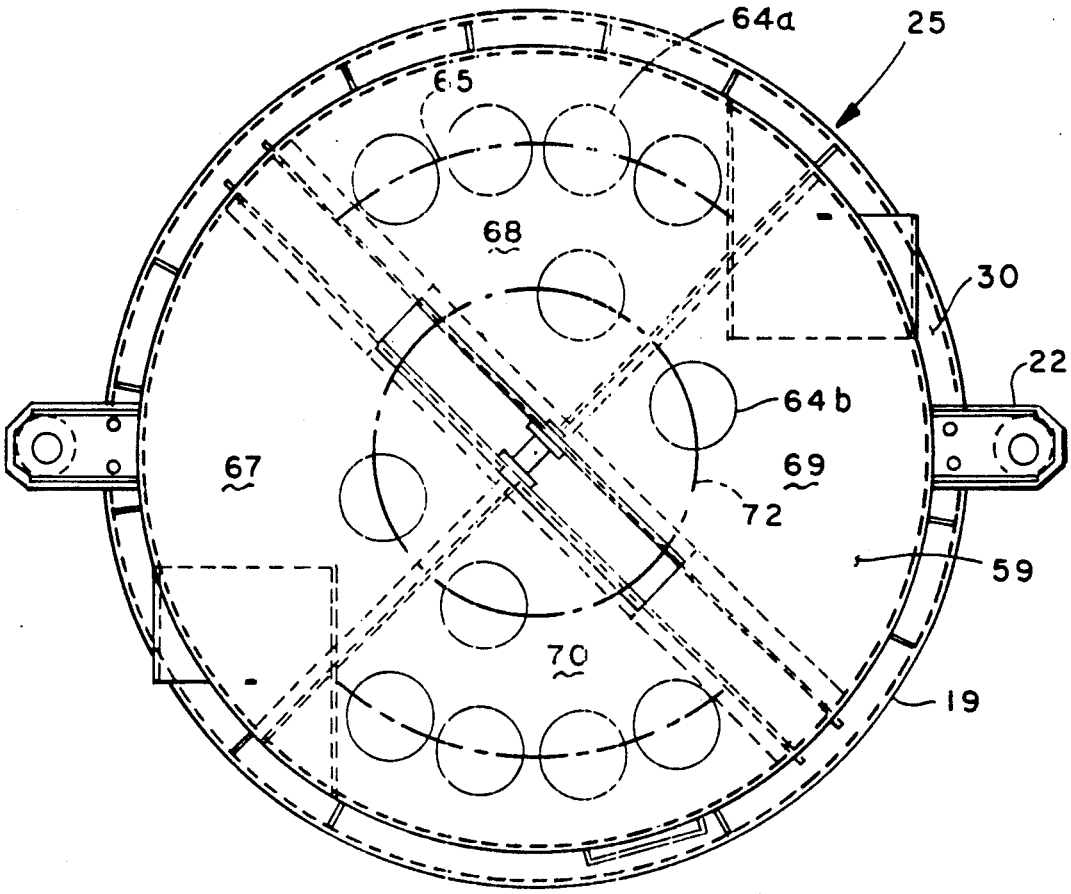
FIG. 6 is a top view of the outer casing of the cooling cover.
Figure 7:
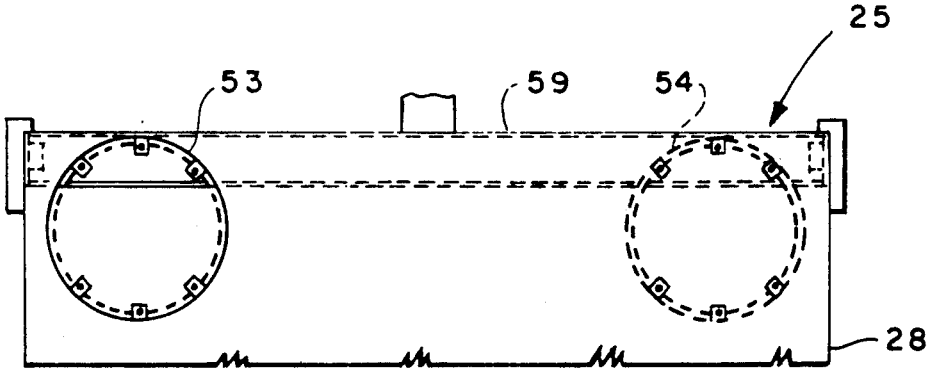
FIG. 7 is a partial, longitudinally sectioned view of the top portion of the outer casing of the cooling cover.

Cooling cover 10 is basically an assembly comprised of two parts which are an outer casing 25 and an inner casing 26. Outer casing 25 is shown in FIGS. 6 and 7 and as part of cooling cover assembly in FIGS. 1 and 3. Cylindrical outer casing 25 includes a longitudinally extending body section 28 having at one axial end a top end 29 and a bottom flanged end 30 at its opposite axial end which carries sand seal lip 19. Suspended within outer casing 25 in a manner which will be described shortly, is cylindrical inner casing 26 with top 34.

Figure 4:
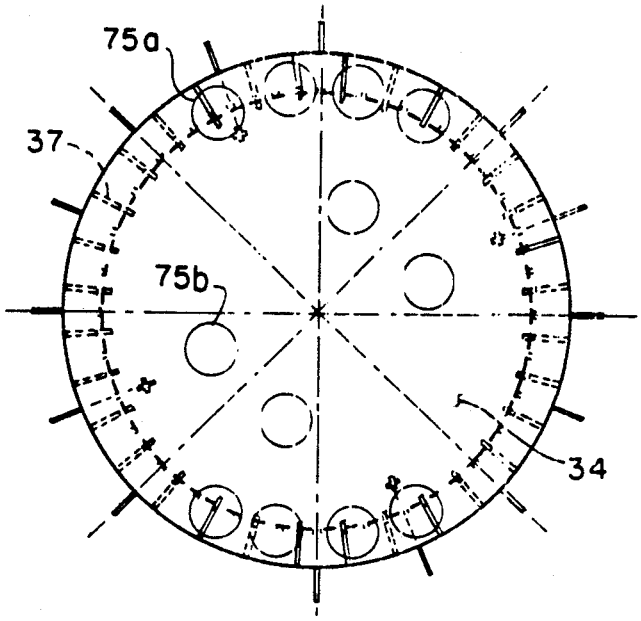
FIG. 4 is a top view of the inner casing of the cooling cover.
Figure 5:
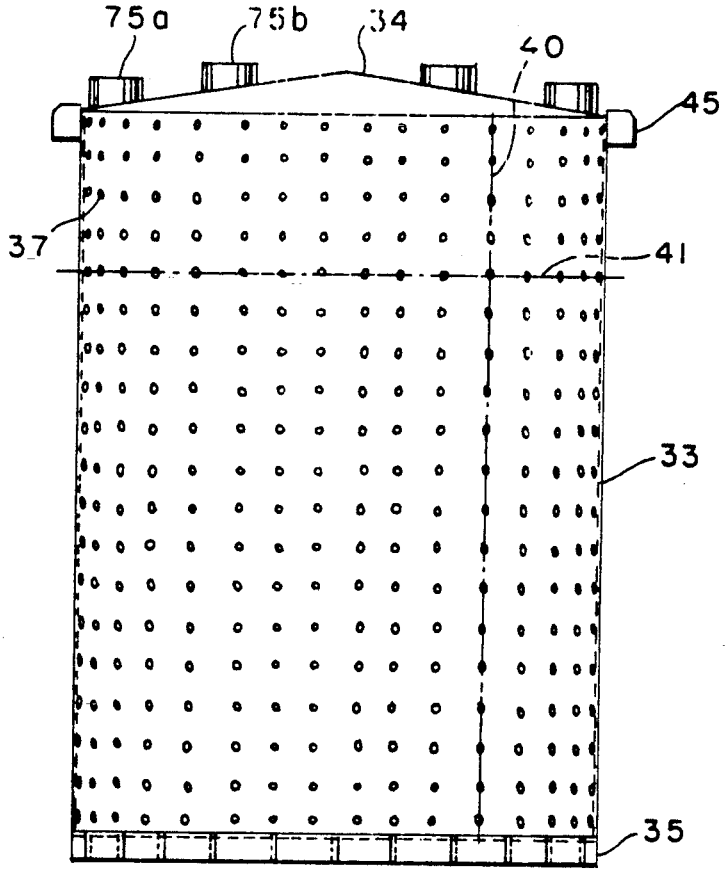
FIG. 5 is a longitudinal view of the inner casing.

Cylindrical inner casing 26 is best shown in FIGS. 4 and 5 and is best illustrated as part of cooling cover 10 assembly in FIG. 3. Similar to outer casing 25, inner casing 26 has a longitudinally extending distributor section or wall 33. Distributor section or wall 33 terminates at one axial end in a conical top end 34 and distributor section or wall 33 terminates at its opposite end in a bottom end 35. Extending radially inwardly from the inner surface of distributor section or wall 33 is a plurality of nozzle tubes 37 as best shown in FIG. 3 (and later explained with reference to FIG. 9). Nozzle tubes 37 extend to a position adjacent the cylindrical section of inner cover 12. As best illustrated in FIG. 5, nozzle tubes 37 can preferably be arranged in longitudinally extending columns 40 and transversely extending rows 41. Other matrixes are possible. This particular vertical/horizontal, row-column matrix has proven effective and is shown as the preferred embodiment.

Inner casing 26 is essentially supported by bottom annular support 46 which extends radially inwardly from outer casing 25 to form the particular configuration illustrated in FIGS. 1 and 3. At circumferentially spaced increments, bottom annular support 36 in turn is supported by gussets 47 secured to outer casing 25. More specifically, inner casing 26 is positioned within outer casing 25 so that the inside surface of body section 28 of outer casing 25 and the outer surface of distributor section or wall 33 of inner casing 26 forms a heat transfer annulus 43 which essentially extends longitudinally (or vertically) from top to bottom of cooling cover 10. Spacers 45 position or center inner casing 26 within outer casing 25. Bottom annular support 46 extending between outer casing 25 and inner casing 26 adjacent bottom end 30 of outer casing 25 and bottom end 35 of inner casing 26 seals heat transfer annulus 43. Importantly because inner casing 26 essentially rests on or is supported by bottom annular support 46, thermal expansion and contraction of inner casing 26 and outer casing 25 can independently occur. This is important because inner casing 26 is exposed to the heat of inner cover 12 while outer casing 25 is exposed to ambient air temperature. Thus a temperature differential exists in cooling cover 10 resulting in differential thermal expansion and contraction of cooling cover components. The suspension of inner cover 26 within outer cover 25 allows the differential expansion/contraction to readily occur without any undue stress or strain on cooling cover 10. Heat transfer annulus 43 is open at or adjacent to top end 29 of outer casing 25 and top end 34 of inner casing 26 but is closed or sealed by annular ring 46 at the bottom or lowest most point of heat transfer annulus 43. Basically, inner casing 26 is supported or resting on annular bottom end 46 and secured at its top end by spacers 45 so that the position illustrated in FIG. 3 results.

Figure 2:
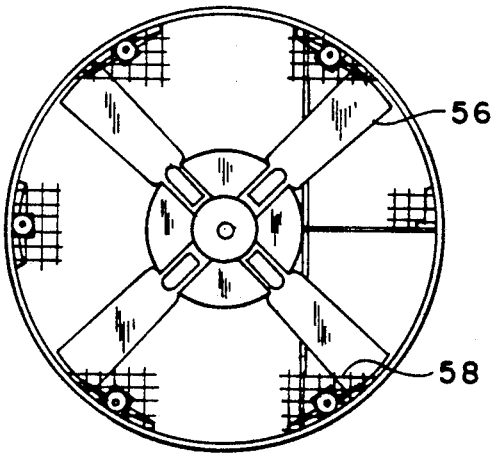
FIG. 2 is a schematic, front view of one of the fans of the invention taken along the lines 2—2 of FIG. 1.

As best shown in FIG. 3 between top end 29 of outer casing 25 and top conical end 34 of inner casing 26 is a closed plenum chamber 50. As shown in FIGS. 6 and 7, formed within outer casing 25 adjacent top end 29 are first and second diametrically opposed, fan mounting-openings 53, 54. Within first and second 53, 54 openings in plenum chamber 50 are mounted first and second axial fans 56, 57. Fans 56, 57 in turn are mounted in a suitable bung as shown in FIG. 2. As best shown in FIG. 1 when first and second fans 56, 57 are operated ambient air is drawn through wire mesh grates 58 in the direction of arrows 60, 61 to cause ambient air to flow within plenum chamber 50 in either a clockwise (as shown) or counter clockwise (not shown) direction. The point is that with the fans swirling the air through plenum chamber 50 there is no path for the abient air to follow except to eventually flow into heat transfer annulus 43 which is in fluid communication with plenum chamber 50 while the air swirls about plenum chamber 50. Swirling the ambient air about plenum chamber 50 is important for exhaust considerations as will be discussed below. In the preferred embodiment, the outside diameter of outer casing 25 is about 128" and the axial fan (available from American Fan Company) has about a 30" impeller and is rated for 200° F. continuous operation with a 7½ horse power motor turning at 1,725 RPM to produce 7,162 CFM.

Perhaps best illustrated in FIG. 3 nozzle tubes 37 extend radially inwardly until their orifices 38 are spaced a close distance relative to the outside surface of inner cover 12. Positioned radially outwardly a slight distance from orifices 38 are a plurality of longitudinally slats 42. Slats 42 longitudinally extend a distance approximately equal to the length of distributor section wall 33 of inner casing 26 to form an inner cylindrical wall 47. Thus an inner return annulus 48 is formed between inner cylindrical wall 47 and distributor section wall 26. Also a jet impingement annulus 49 is defined to extend between inner cylindrical wall 47 and the outside surface of inner cover 12. Slats 42 have edge openings which allow them to rest on and pivot about nozzle tubes 37. Importantly this allows inner return annulus 48 to be in fluid communication with jet impingement annulus 49. Other arrangements are possible to achieve the desired fluid communication. One such alternative arrangement is disclosed in FIG. 12.

Openings are provided in top end 29 of outer casing 25 and top end 34 of inner casing 26 to permit exhaust of ambient air drawn into outer cover 10 by fans 56, 57. The size and position of the openings is important to the efficient or optimal working of the invention as will be explained later. As best shown in FIG. 6, there is a plurality of circular access openings 64 cut into top end 29 of outer casing 25. A majority of access openings 64*a* are centered and circumferentially spaced on an imaginary circle designated by reference numeral 65 in FIG. 6. The diameter of imaginary circle 65 is such that access openings 64*a* overly nozzle tubes 37 (best shown in FIG. 3) and specifically inner return annulus 48. Furthermore, access openings 64*a* are within quadrants adjacent the quadrants in which fans 53, 54 discharge ambient air. That is, top end 29 of outer casing 25 can be conveniently divided into first, second, third and fourth quadrants designated by reference numerals 67, 68, 69 and 70, respectively. Assuming first axial fan 56 discharges into first quadrant 67, then second fan 57 will discharge into third quadrant 69. Access opening 64*a* are positioned then in second and fourth quadrant 68, 70. By positioning access opening 64*a* in this manner, the discharge of the fans will be 90° when the fan discharge contacts access openings 64*a*. It is believed that this helps the jet pump action of the invention to occur as described below. There are also positioned radially inwardly spaced access openings 64b which like access openings 64a are positioned on an imaginary circle designated by reference numeral 72. Radially inwardly spaced access opening 64b are positioned to enhance heat transfer characteristics of cooling cover 10. In the preferred embodiment illustrated, there are eight outer access openings 64a and 4 inner access openings 64b. All access openings 64 are dimensioned approximately the same, and in the preferred embodiment have a diameter of about 13".

Figure 8:
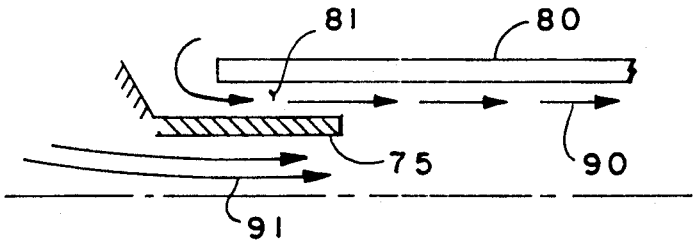
FIG. 8 is an enlarged partial, longitudinally-sectioned view of a detail of a jet pump construction.

Access openings 64 are in alignment (concentric) with and overlie draw cylinder openings 75 formed in top end 34 of inner casing 26 which in turn provide access to the interior of inner casing 26. Thus, as perhaps best shown in FIG. 4, there are eight radially outwardly draw cylinder openings 75a and 4 radially inwardly positioned draw cylinder openings 75b. Draw cylinder openings 75 are centered on the same imaginary circles 65, 72 as are access openings 64. As best shown in FIGS. 1 and 3 extending within each access opening 64 and welded to each access opening 64 is a jet pump tube 80. The inside diameter of jet pump tube 80 is larger than the outside diameter of draw cylinder opening 75 so as to define a jet pump annulus 81 there between (best shown in FIG. 8). There is, of course, a wire mesh screen covering 83 at the outlet of each jet pump tube 80 to prevent debris from falling into outer cover 10.

In operation, fans 56, 57 pump a relatively large volume of ambient air into plenum chamber 50 at a relatively low pressure. The air is swirled about plenum chamber 50 and forced into heat transfer annulus 43. Since heat transfer annulus 43 dead ends or is blocked at annular seal ring 46, the ambient air is forced out through nozzle tubes 37. The outlet for each nozzle tube 37 may be properly viewed as an orifice 38 which directs the ambient air as a jet against inner cover 12 (FIG. 9). More particularly, and as discussed above in the background, an earlier design simply had holes drilled into distributor section or wall 33 from which the ambient air escaped through the holes or orifices as jets which impinged inner cover 12. It was determined in the prior arrangement, that the jets were less efficient for heat transfer. To overcome this, nozzle tubes 37 were utilized. Nozzle tubes 37 had the effect of moving the orifice 38 closer to inner cover 12. Importantly, the length of nozzle tube 38 created, in itself, a back pressure, which had the effect or resulted in a uniform pressure of the ambient air throughout the length of heat transfer annulus 43. Thus, the velocity of the jet streams leading orifices 38 of say the top nozzle designated as reference numerals 37a (in FIG. 3) was approximately equal to the velocity emanating from nozzle tubes at the bottom of distributor section or wall 33 designated by reference numeral 37b (FIG. 3). Thus, the combination of heat transfer annulus 43 and the length and size of nozzle tubes 37 produce uniform free standing jet streams of ambient air for all of nozzle tubes 37. That is, air at ambient temperature is emitted from nozzle orifices 38 at light speeds sufficient to produce free standing conical jets which expand as a right angle cone until they come into turbulent contact with inner cover 12 as shown schematically by the arrows in FIG. 9. Further, simply by dimensionally sizing the nozzle tubes 37 and heat transfer annulus 43 low pressure fans in plenum chamber can develop sufficient pressures within nozzle tubes 37 to produce free standing jet streams which are surprisingly uniform in velocity for all nozzle tubes 37a, 37b. This, in turn, generates improved heat transfer with the inner cover 12. For example, based on tests conducted, heat transfer coefficients of 25 to 40 BTU/(HR-FT$^2$-° F.) were measured compared to conventional cooling covers which typically offer coefficients of between 3 to 5 BTU/(HR-FT$^2$-° F.). This is an average of about 8 times better heat removal potential based on heat transfer co-efficients. Production tests show cooling cycles with a cover constructed along the concepts disclosed herein of 32 hours compared to a cooling time of 46 hours produced by other "updraft" cooling covers. That is, production tests show that cooling from an annealing transformation temperature in excess of 1200° F. to a coil temperature slightly in excess of 200° F. took a conventional design 46 hours in contrast to a design constructed along the inventive concepts discussed herein of 32 hours.

It should be clear to those skilled in the art that after the jets emanating from nozzle tubes 37 strike inner cover 12, (and without any further modification) they will uniformly flare out in all directions. That is, the "spent" jet will distribute itself about the surface of inner cover 12 in all directions. "Spent" means what is left of the jet after initial impingement and thus initial heat transfer contact with inner cover 12. Note that after jet strikes inner cover 12 it begins to spread and picks up heat from inner cover 12. Furthermore, how the jet spreads could affect the impingement of the adjacent jets and this then affects the temperature of inner cover 12. If temperature of inner cover 12 is not uniform, then despite the presence of annealing stand recirculating fan 16, coils 13 will not be uniformly cooled. The invention uniquely solves this problem. First, it establishes a jet stream pattern vis-a-vis nozzle 37 length and placement. Then importantly, it provides for removal of the spent jets in a non-interfering manner. This is done by providing first the escape path of the spent jets through slats 42 into inner return annulus 48 plus the draw established by jet pump tubes 80. In other words a return path is provided and a force or a draw is provided to cause the heated air to egress cooling cover 10 by means of return path or inner return annulus 48 -jet pump tubes 80. Besides allowing the preferred jet impingement pattern to occur on inner cover 12, the lowermost jets through nozzle tubes 37b do not spread out to impinge or pressurize sand seal 19. If anything, the exodus of the gas creates a negative pressure at sand seal 19 maintaining seal integrity.

In accordance with one of the inventive concepts disclosed herein, this problem is solved by the provisions of jet pump tubes 80. More specifically, and referring to FIG. 8 there is a jet pump annulus 81 formed between the outside diameter of draw cylinder 75 and the inside diameter of jet pump tube 80. For example, in the preferred embodiment the outside diameter of draw cylinder 75 is about 11 13/16" and the inside diameter of jet pump tube 80 can be assumed to be about 13". This produces an annulus having a radial dimension of about 9/16" which has a length of about 3". When ambient air is circulated by fans 53, 54 into plenum chamber 50 that ambient air is pumped through jet pump annulus 81 as an annulus of air about the inside diameter of jet pump tube 80 as indicated by arrows 90 in FIG. 8. This annulus of ambient air travelling about the I.D. of jet pump tube 80 as a pump creates an entrainment or a suction within draw cylinder 75 to in turn cause a draft with sufficient force to pull the spent gas jet streams shown by reference arrows 91 in FIGS. 8 and 9 from cooling cover 10. The velocity of ambient air annulus 90 is sufficient and sufficiently sized to pull the air within inner casing 26 to exhaust and is significantly more than what would occur if draw cylinder 75 was simply open to exhaust. In fact, the draw or the suction through draw cylinder 75 is such so as to cause a neutral (i.e., pressure at standard atmosphere) or a slight under pressure to exist at the bottom of cooling cover 10 adjacent nozzle tubes 37*b*. Because the atmospheric pressure within cooling cover 10 adjacent the sand seals is neutral or is at a slight under pressure, leakage of the flow of combustion gases to the outside would be much slower than that which would otherwise occur as a result of positive pressure. Thus cooling cover 10 can be used in those installations employing sand seals.

Figure 10:
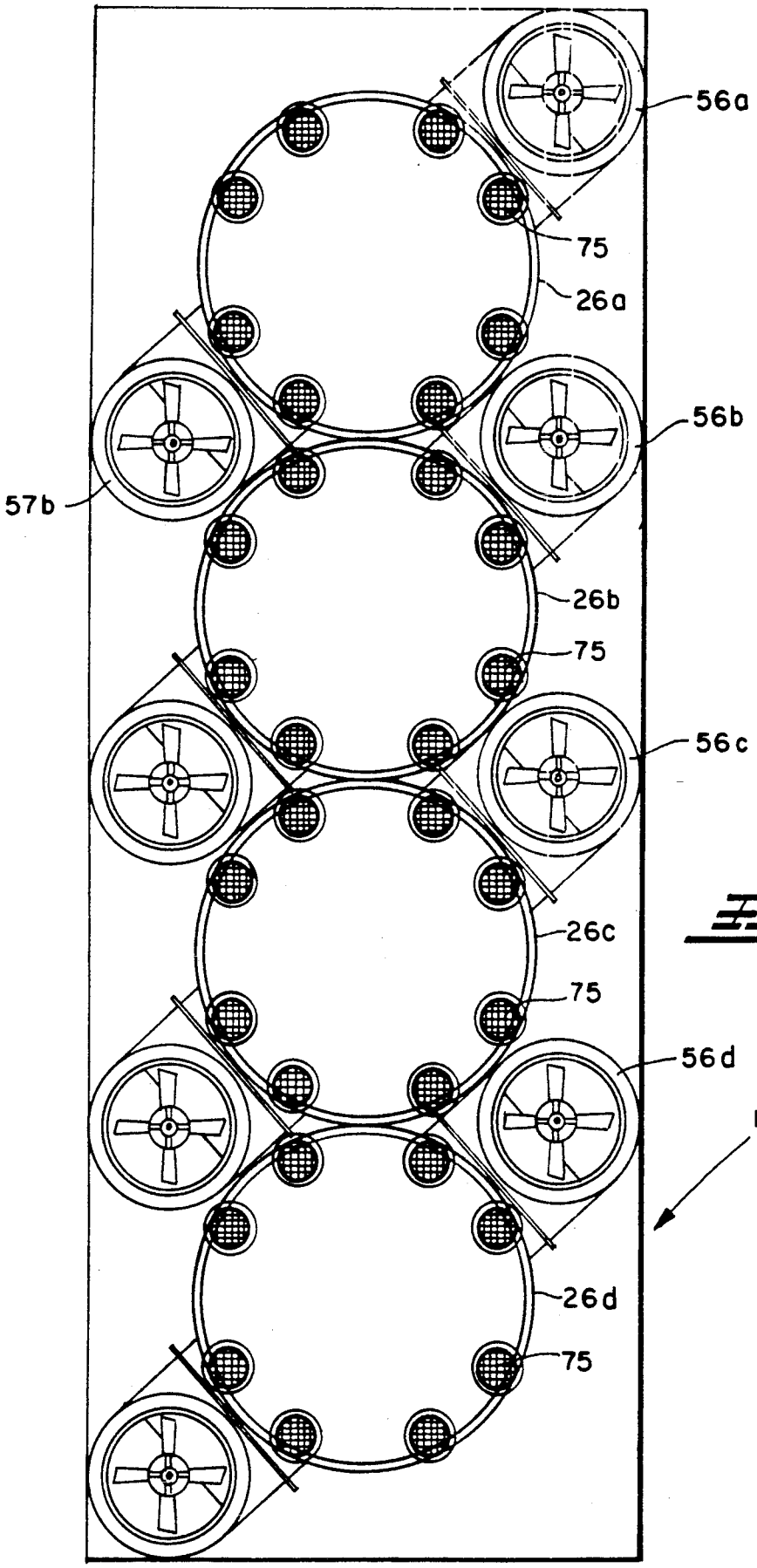
FIG. 10 is a top view similar to FIG. 1 showing a multi-stand annealing cooling cover as an alternative embodiment.
Figure 11:
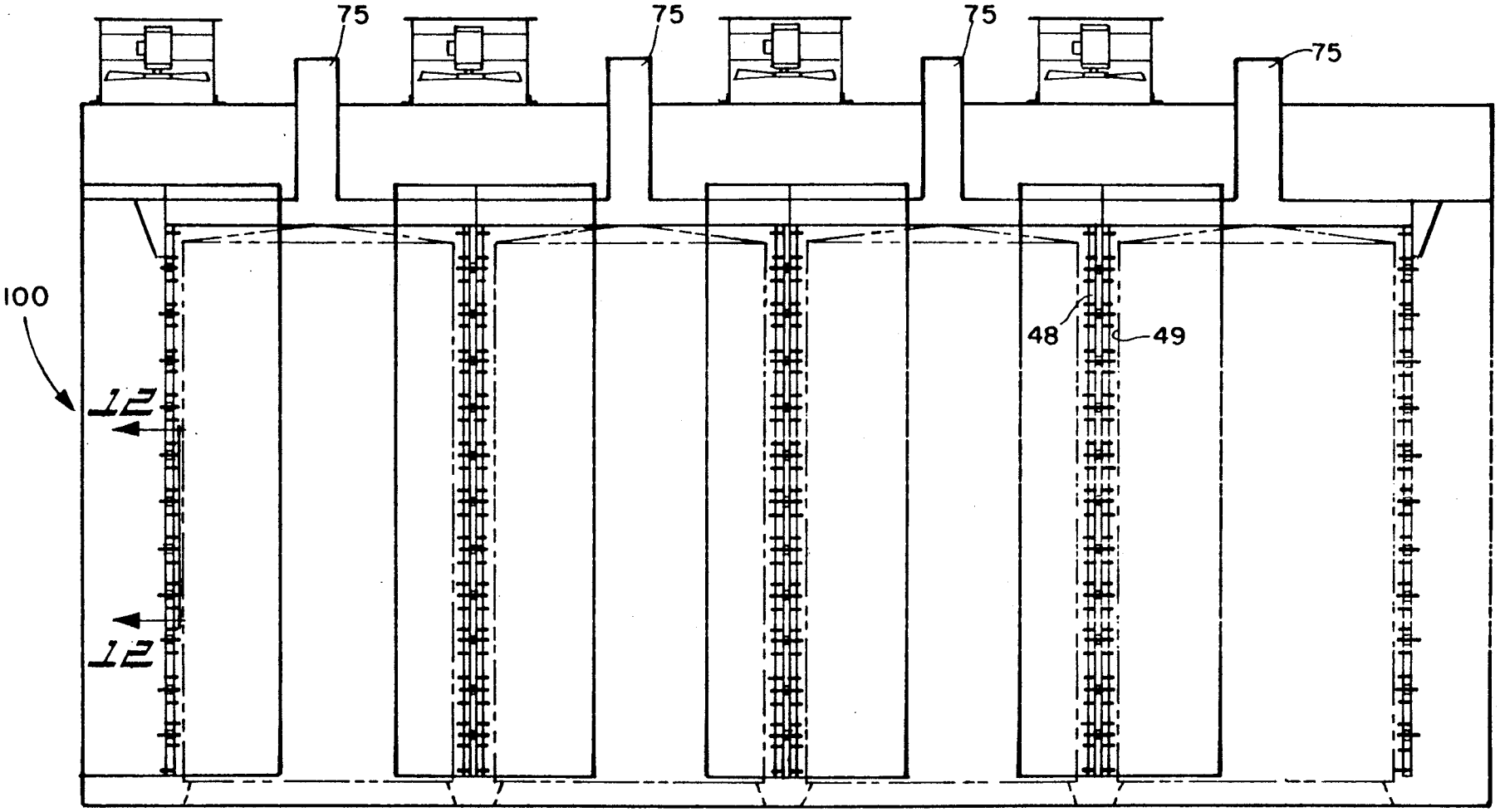
FIG. 11 is a longitudinal view similar to FIG. 3 of the cooling cover shown in FIG. 10.
Figure 12:
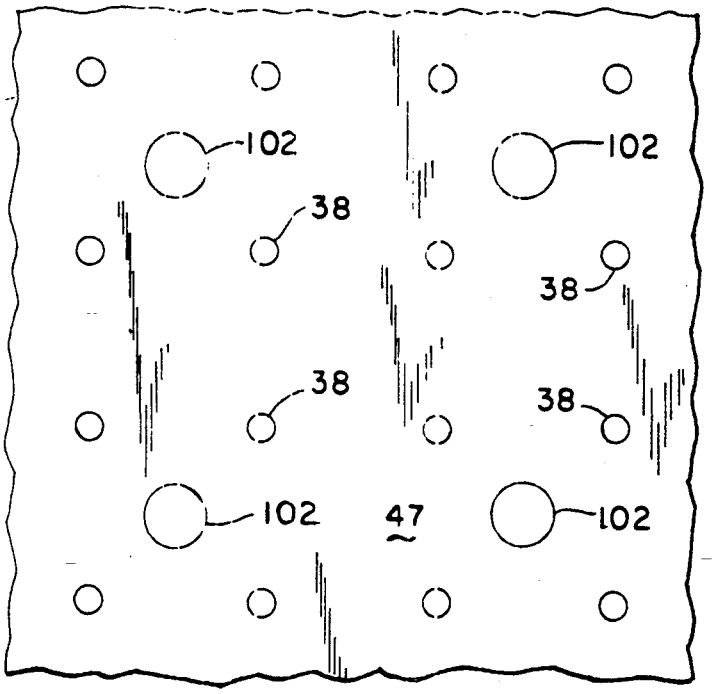
FIG. 12 is a partial plan view showing hole position taken along lines 12—12 of FIG. 11.

The invention has been described thus far with reference to a single stand cooling cover 10. FIGS. 10, 11 and 12 show the invention applies as a multi-stand cooling cover 100. Specifically, a four stand annealer is illustrated, and reference numerals previously used in FIGS. 1–9 will apply to describe like parts and components for FIGS. 10–12 where applicable. Multi-stand annealer 100 differs from single stand annealer 10 in that only eight radially outwardly draw cylinders 75 are employed. This is possible because of dual usage of fan output. That is first fan 56*b* pumps air for both inner casings 26*a* and 26*b* so that the fan 56, 57 positioning results in a more efficient utilization of the fan's output. A second difference is the orifice 38 pattern and the communication between jet impingement annulus 49 and inner return annulus 48. As best shown in FIG. 12 inner cylindrical wall 47 is solid and is not composed of slats. An annular return opening 102 is provided in inner cylindrical wall 47 for the desired communication. The matrix and hole positioning is as shown in FIG. 12.

The invention has been described with reference to a preferred and an alternative embodiment. Specifically, the invention has been described in the context of cooling. It is believed that those skilled in the art will recognize that the invention can also be applied to heating inner cover 12 as well as cooling with some modifications. It is contemplated that heating could be accomplished by mounting a gas fired line burner within plenum chamber 50 and by metering the flow of ambient air from fans 54, 56. Essentially, fan pressure would be used to circulate the products of combustion during heating. A recirculating fan would be used because the reduced flow of the products of combustion would reduce the suction of the jet pump. For cooling, the burners would be shut off so that the fan pressure would be used to circulate cold burner combustion air. The jet pump draw characteristics of the present invention would not be that significant to the modification discussed herein which is achieved, principally, by the recirculating fan. In this way, cooling cover 10 can also act as a heating cover. The concept is simply mentioned as a modification which might suggest itself to one skilled in the art. It is intended to include all such modifications insofar as they come within the scope of the present invention.

Having thus described the invention, it is now claimed:

1. An outer cover for use as a staple component of a bell shaped furnace in which said outer cover surrounds an inner cover within which work to be heat treated is placed, said outer cover comprising:

i) an outer cylindrical casing having a longitudinally-extending body section, a closed top end and an open, flanged bottom end;

ii) an inner cylindrical casing having a longitudinally-extending, distributor section, a closed top end and a bottom end; a plurality of jet nozzle means associated with said distributor section for directing jets of a gaseous medium into heat transfer impingement with said inner cover;

iii) said inner casing disposed within said outer casing to define a longitudinally extending heat transfer annulus between the inside of said outer casing's body section and the outside of said inner casing's distribution section, said heat transfer annulus closed at its bottom axial end and open at its top axial end;

iv) said top end of said inner casing spaced a distance from said top end of said outer casing to define therebetween a plenum chamber, said top end of said heat transfer annulus in fluid communication with said plenum chamber; and v) at least one draw opening at a position within said top end of said inner and said outer casings and jet pump means associated with said draw opening for creating jet pump aspiration from said opening for positively drawing gases within said outer cover out of said outer cover whereby pressure within said outer cover adjacent said inner and said outer casing's bottom end is anywhere from neutral to slightly negative while said jet nozzle means impingement pattern on said inner cover is enhanced for heat transfer with work within said inner cover.

2. The outer cover of claim 1 further including fan means within said top end of said outer casing for circulating said gaseous medium at pressure within said plenum chamber.

3. The outer cover of claim 2 wherein said fan means includes a pair of diametrically opposed fan openings in said outer casing top end, a fan in each opening having an impeller for pulling ambient air into said plenum in opposite directions to the other fan whereby said ambient air is swirled about said plenum chamber.

4. The outer cover of claim 1 wherein said jet nozzle means includes a plurality of nozzle tubes extending radially inwardly from said distribution section to a position adjacent said inner cover, each tube having at its open end an orifice opening for developing a free standing circular jet of gaseous products emanating therefrom.

5. The outer cover of claim 4 further including a cylindrical inner wall adjacent said orifices and receiving said nozzle tubes, said inner cylindrical wall and said longitudinal section of said inner casing defining an inner return annulus, said inner return annulus in fluid communication with said jet pump means; said inner cylindrical wall and said outer surface of said inner cover defining a jet impingement annulus, and means providing fluid communication between said jet impingement annulus and said inner return annulus whereby said jet pumps can draw ambient air after impingement with said inner cover from said jet impingement annulus through said inner return annulus and said jet pump means to ambient atmosphere outside said cover while developing an improved jet impingement pattern about said inner cover.

6. The outer cover of claim 5 wherein said jet pump means includes said draw opening in said inner casing top end having a cylindrical draw pipe of a first diameter extending therefrom, said draw opening in said outer casing having a cylindrical suction pipe of a second diameter mounted thereto, said suction pipe having a second diameter greater than said first diameter and extending over said draw pipe for a predetermined distance thereof, said suction pipe and said draw pipe defining a jet pump annulus therebetween for causing said draw pipe to function as a pump for drawing gases within said outer casing out of said outer cover.

7. The outer cover of claim 6 wherein there is a plurality of draw openings, at least one draw opening overlying said inner return annulus.

8. The outer cover of claim 7 further including at least one draw opening positioned radially inwardly from said draw opening overlying said inner return annulus.

9. The outer cover of claim 8 wherein said plenum chamber is divided into quadrants with said fans mounted in diametrically opposed quadrants and said draw openings overlying said inner return annulus are positioned in quadrants adjacent to those containing said fans.

10. The outer cover of claim 1 wherein said jet pump means includes said draw opening in said inner casing top end having a cylindrical draw pipe of a first diameter extending therefrom, said draw opening in said outer casing having a cylindrical suction pipe of a second diameter mounted thereto, said suction pipe having a second diameter greater than said first diameter and extending over said draw pipe for a predetermined distance thereof, said suction pipe and said draw pipe defining a jet pump annulus therebetween for causing said draw pipe to function as a pump for drawing gases within said outer casing out of said outer cover.

11. The outer cover of claim 1 wherein said outer cover surrounds a plurality of inner covers, said inner casing surrounding each inner cover and suspended within said outer casing whereby said outer cover is suitable for use in a multi-stand batch coil annealing furnace.

12. In a bell shaped heat treating furnace, comprising a stand upon which work is placed, an inner bell shaped cover surrounding said work removably sealed to said base and an outer, bell shaped cover surrounding said inner cover, the improvement comprising:

a) a plurality of nozzle tubes within said outer cover spaced adjacent to said inner cover, each tube having an orifice outlet, and means to pressurize gaseous medium within said tubes for generating free standing jet streams of a gaseous medium emanating from each orifice into heat transfer impingement with said inner cover; and b) jet pump means formed in said outer cover for drawing said jet streams, after impingement with said inner cover, out of said outer cover so that gaseous pressure within said outer cover at a position adjacent the base of said outer cover is neutral to slightly negative for ease in maintaining the sealing of said outer cover.

13. The furnace of claim 12 wherein said outer cover includes an outer cylindrical casing having a longitudinally-extending body section, an open flanged bottom end and a closed top end and an inner cylindrical casing having a longitudinally-extending distribution section, a bottom end and a closed top end; said inner casing positioned within said outer casing to define a longitudinally extending heat transfer annulus extending between said outer casing's body section and said inner casing's distribution section; said top end of said inner cover spaced from said top end of said outer cover to define a plenum chamber therebetween, said heat transfer annulus in fluid communication with said plenum chamber; said plurality of nozzle tubes extending from said inner cover's distribution section and in fluid communication with said heat transfer annulus; said jet pump means including at least one opening formed in said top end of said inner casing and at least one opening formed in said top end of said outer casing.

14. The furnace of claim 13 wherein including fan means within said top end of said outer casing for circulating said gaseous medium within said plenum chamber.

15. The furnace of claim 14 wherein said fan means includes a pair of diametrically opposed fan openings in said outer casing top end, a fan in each opening having an impeller for pulling ambient air into said plenum in opposite directions to the other fan whereby said ambient air is swirled about said plenum chamber.

16. The furnace of claim 13 wherein said jet nozzle means includes a plurality of nozzle tubes extending radially inwardly from said distribution section to a position adjacent said inner cover, each tube having at its open end an orifice opening for developing a free standing circular jet of gaseous products emanating therefrom.

17. The furnace of claim 16 further including a cylindrical inner wall adjacent said orifices and receiving said nozzle tubes, said inner cylindrical wall and said longitudinal section of said inner casing defining an inner return annulus, said inner return annulus in fluid communication with said jet pump means; said inner cylindrical wall and said outer surface of said inner cover defining a jet impingement annulus, and means providing fluid communication between said jet impingement annulus and said inner return annulus whereby said jet pumps can draw ambient air after impingement with said inner cover from said jet impingement annulus through said inner return annulus and said jet pump means to ambient atmosphere outside said cover while developing an improved jet impingement pattern about said inner cover.

18. The furnace of claim 17 wherein said jet pump means includes said draw opening in said inner casing top end having a cylindrical draw pipe of a first diameter extending therefrom, said draw opening in said outer casing having a cylindrical suction pipe of a second diameter mounted thereto, said suction pipe having a second diameter greater than said first diameter and extending over said draw pipe for a predetermined distance thereof, said suction pipe and said draw pipe defining a jet pump annulus therebetween for causing said draw pipe to function as a pump for drawing gases within said outer casing out of said outer cover.

19. The furnace of claim 18 wherein there is a plurality of draw openings, at least one draw opening overlying said inner return annulus.

20. The furnace of claim 19 wherein including at least one draw opening positioned radially inwardly from said draw opening overlying said heat transfer annulus.

21. The furnace of claim 20 wherein said plenum chamber is divided into quadrants with said fans mounted in diametrically opposed quadrants and said draw openings overlying said heat transfer annulus are positioned in quadrants adjacent to those containing said fans.

22. The furnace of claim 13 wherein said jet pump means includes said draw opening in said inner casing top end having a cylindrical draw pipe of a first diameter extending therefrom, said draw opening in said outer casing having a cylindrical suction pipe of a second diameter mounted thereto, said suction pipe having a second diameter greater than said first diameter and extending over said draw pipe for a predetermined distance thereof, said suction pipe and said draw pipe defining a jet pump annulus therebetween for causing said draw pipe to function as a pump for drawing gases within said outer casing out of said outer cover.

23. The furnace of claim 13 wherein said outer cover surrounds a plurality of inner covers, said inner casing surrounding each inner cover and suspended within said outer casing whereby said outer cover is suitable for use in a multi-stand batch coil annealing furnace.

24. A process for cooling work heat treated in a bell shaped furnace employing a bell shaped inner cover surrounding the work, a bell shaped outer cover surrounding said inner cover and a plurality of nozzle tubes in said outer cover, each nozzle tube having an outlet orifice in close proximity to said inner cover, said process comprising the steps of:

a) flowing a gaseous cooling medium through said nozzle tubes at velocities sufficient to form a free standing circular jet of a gaseous cooling medium from each orifice of each tube, and impinging said inner cover with said jets to effect heat transfer contact between said gaseous medium in said jets and said cover; and b) flowing a gas longitudinally within an exhaust duct at a position remote from said tube jets at velocities sufficient to create a suction jet pump and drawing by said jet pump said gaseous atmosphere through said exhaust dust after said tube nozzle jets having impacted said inner cover and are spent.

* * * * *